United States Patent [19]

Ulman

[11] Patent Number: 4,460,178

[45] Date of Patent: Jul. 17, 1984

[54] FRICTION AND WEAR REDUCING SYSTEM FOR LACROSSE STICKS

[76] Inventor: James W. Ulman, 4012 Federal Hill Rd., Jarrettsville, Md. 21084

[21] Appl. No.: 445,685

[22] Filed: Dec. 1, 1982

[51] Int. Cl.[3] ..... A63B 59/02
[52] U.S. Cl. ..... 273/326
[58] Field of Search ..... 273/326, 73 D

[56] References Cited

U.S. PATENT DOCUMENTS 3,507,495 4/1970 Tucker et al. ..... 273/326

FOREIGN PATENT DOCUMENTS 212195 3/1924 United Kingdom ..... 273/73 D
424742 2/1935 United Kingdom ..... 273/326

OTHER PUBLICATIONS

The Sporting Goods Dealer, May 1975 p. 149 "Fiberglass Tubing Used For Adistar".

*Primary Examiner*—William H. Grieb
*Attorney, Agent, or Firm*—John F. McClellan, Sr.

[57] ABSTRACT

An improvement in lacrosse equipment reduces scooping friction with the ground and wear on the lower strung portion at the hook of a lacrosse stick by means of "U"-shaped tubular protectors on respective strings, each with the apex of the "U" acting as a fairlead through the frame, and, with the protector stabilized by abutment of the respective arms of the "U" against the forward knots of netting at the throw strings, and by broadening of the protector at the "U"-shaped bend, jamming it in the holes and causing the lower runs to extend resiliently down from the holes as respective skids easing wear on the transverse portion of the lacrosse stick and the thongs at the playing surface when scooping up a lacrosse ball.

2 Claims, 3 Drawing Figures

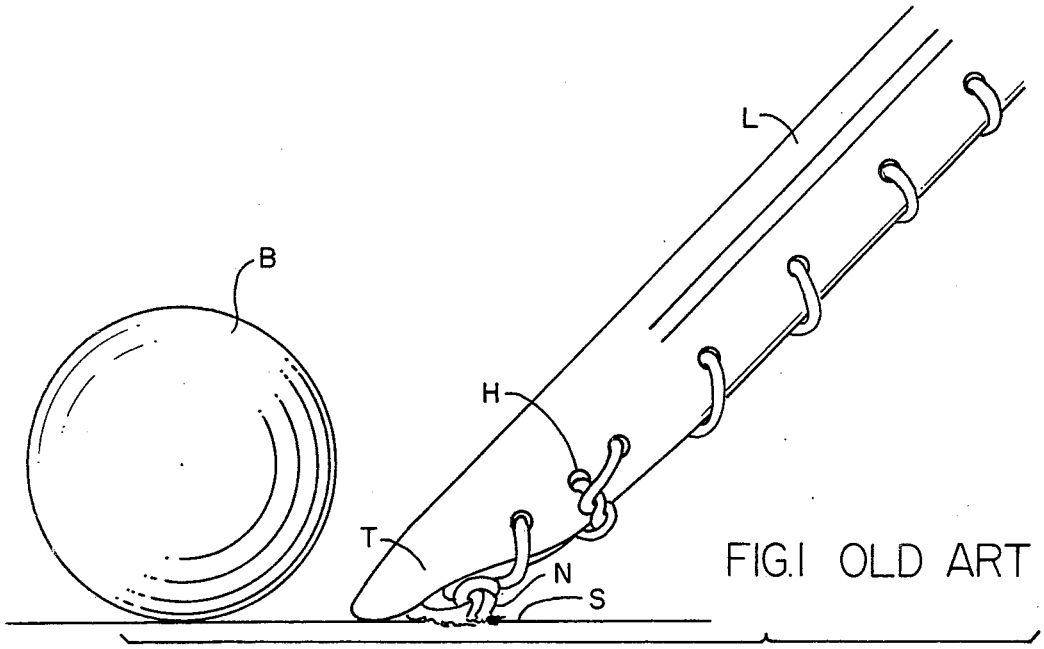
FIG.1 OLD ART
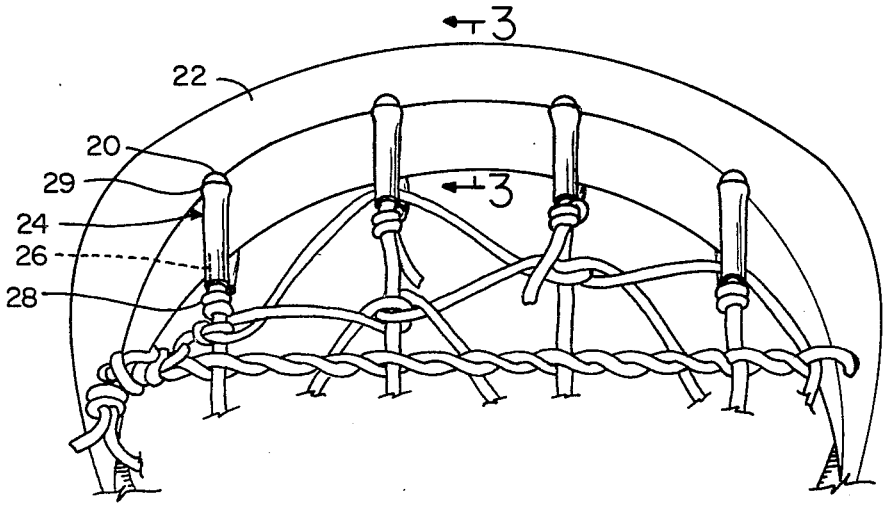
FIG. 2
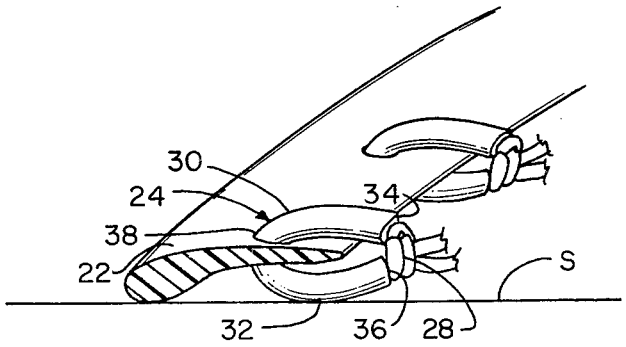
FIG. 3

FRICTION AND WEAR REDUCING SYSTEM FOR LACROSSE STICKS

FIELD OF THE INVENTION

This invention relates generally to sports equipment and specifically to an improved lacrosse stick system.

BACKGROUND OF THE INVENTION

Lacrosse sticks and the netting parts of them are subjected to stress and frictional forces that sooner or later wear them beyond safe use, or beyond any use at all.

The fastest wear and heaviest impacts occur at the forward end of the stick, on the transverse portion and on the pocket-supporting thongs looped through holes in the transverse portion and returned beneath the transverse portion to the pocket at the throwing strings.

"Nylon" thongs, although preferred over traditional leather thongs or gut for resistance to mis-shaping in the pocket and for rot-resistance, are easily abraded by ground-contact of the stick transverse or forward portion in scooping the ball up; so is fibreglass stick construction in that area, and hickory sticks may splinter when abused in play. Heavy friction of ground contact can reduce speed of manipulation of stick and ball. Even friction between the stick and strung loops passed through it, can produce wear.

Principal objects of this invention therefore are to provide a lacrosse stick system which drastically reduces ground-contact friction and wear of string and frame, thereby lowering costs of play and improving safety and which can cushion impacts with stoney ground and other hard surfaces.

Further objects are to provide a system as described which improves playing characteristics, is reliable, light in weight, low in cost, and attractive in appearance.

BRIEF DESCRIPTION OF THE DRAWINGS

The above and other objects and advantages of this invention will become more readily apparent on examination of the following description, including the drawings in which like reference numerals refer to like parts.

FIG. 1 is a side elevational fragmentary detail of old art lacrosse stick equipment in position for scooping up a ball;

FIG. 2 is a bottom plan view fragmentary detail of lacrosse stick equipment and improvements thereon according to this invention, and FIG. 3 is a side elevational sectional detail taken at 3—3, FIG. 2.

DETAILED DESCRIPTION

OLD ART

FIG. 1 shows old art, in which thongs of netting N of a lacrosse stick L abrade against the playing field surface S in scooping up a ball B and in similar playing maneuvers. The thongs looped through holes H and returned to the netting are susceptible to displacement, as, for example, forwardly under the transverse portion T of the stick as indicated, where downward pressure of the stick can add to wear.

Chafing at the hole H as the loops shift in them is also destructive. Scrubbing to the side similarly can damage the equipment, in addition to the general wear and tear of pounding. Taping the loops has been tried for years but has proved unsatisfactory because of time consumption expense, and fraying and other wear.

THE INVENTION

The following Figures show how the invention substantially eliminates traditional problems at the points of greatest wear.

FIG. 2 shows in plan view that the holes 20 in the transverse portion 22 of a conventional lacrosse stick (the one shown may be of fibreglass) may be enlarged, members which are lengths of special tubing 24 jammed through the holes, "Nylon" thongs 26 from the conventional lacrosse stick knotted-netting looped through the tubing lengths and tightly returned around the transverse portion of the stick, pulling the tubing into "U"-shape, and rejoining by conventional knots 28 the netting. All fore-and-aft loops, or loops in the forward or transverse portion of the lacrosse stick should be provided with tubing according to this invention. Thus, each one of these connective loops holds a respective "U"-shape tubing, drawn tightly and fixed into position as a fairlead by the first and second or upper and lower runs of the loop, and further by abutment on at least one knot of at least the lower arm (preferably by abutment of both arms on a knot). Each arm of the "U"-shaped member may, for speed and economy of manufacture, be the same length. The bends broaden the tubing, fixing it in the holes by a jamming effect, with a flat 29, in plan view, resulting.

FIG. 3 shows in elevational sectional view, a fragmentary detail of the above provision, the "U"-shape tubing 24, upper and lower arms 30, 32, thereof, with ends 34, 36 abutting on a knot 28, and the relation to the lacrosse stick transverse portion 22. As indicated, means retaining the "U"-shaped tubing include preferably abutment of each end of each arm of the "U"-shaped tubing (include preferably abutment of each end of each arm of the "U"-shape on the respective knot forming the loop). This is one shift-inhibiting feature, and further the tubing is semi-rigid but tough and flexible so that, as noted, crimping of the curved portion 38 of each "U"-shape broadens the tubing lateral cross-section at each hole (as better shown in the preceding Figure) further limiting motion.

The lower arm 32 of each "U" shape tubing portion resiliently protrudes like a skid below the transverse portion of the stick, protecting the thongs and knots from abrasion, reducing wear and shock on the lacrosse stick transverse portion or forward end, and reducing friction of contact with the playing surface S. This same resilient downward protrusion tends to space the lateral loops of the throwing strings upwardly from the playing surface and relieve wear there, even though they are not otherwise shielded. The tubing should be substantially inextensible, and continuous with arcuate arms.

The tubing end must not have edges capable of cutting or chafing "Nylon", and must not bind on "Nylon"; that is, in addition to the requirements of stiffness, toughness, flexibility and substantial freedom from stretching, it must be soft and smooth and not bondable to "Nylon" under mild pressure and heat.

Tubing satisfying these requirements is difficult to find. Surprisingly, truck air-line tubing identified and sold as "DOT PFT" also as "Parflex" tubing and is "PVT" tubing, by Parker Hannifin Inc. of 905 Masefield Road, Cantonsville, Md., meets all these requirements when used with the $\frac{1}{8}$ inch (3 mm) diameter round-section braided "Nylon" cord used for lacrosse stick webbing.

Size of the tubing is preferably $\frac{1}{4}$ inch (6 mm) O.D. by 3/16 inch (5 mm) I.D. It may be cut to length using scissors, the extended length being about $1\frac{3}{8}$ inches (34 mm). Hole diameter in a lacrosse stick may be slightly less than the tubing O.D., making a press fit. Weight of the usual member used in a lacrosse stick is negligible—only a fraction of an ounce.

This invention is not to be construed as limited to the particular forms disclosed herein, since these are to be regarded as illustrative rather than restrictive. It is, therefore, to be understood that the invention may be practiced within the scope of the claims otherwise than as specifically described.

What is claimed and desired to be protected by United States Letters Patent is:

1. In a lacrosse stick system having a frame with a transverse front portion, netting including a plurality of knots defining a throwing string pocket at said transverse front portion, the transverse front portion having a plurality of holes, a respective loop of thong passing from said netting through each hole, each loop of thong having an upper run and a lower run, the upper run and the lower run of each loop of thong terminating together at a respective knot, the improvement comprising: means for reducing friction and wear on said transverse front portion, on each loop of thong and on said netting, in the form of skid-like structure protrusive below said transverse front portion including: a resilient member on each of said loops, each loop drawing the respective resilient member thereon into a "U"-shaped bend with first and second arms, each "U"-shaped bend being adjacent a respective said hole, and means for retaining each resilient member in place, including each resilient member being a resilient tubular member.

2. In a lacrosse stick system as recited in claim 1, at least one of said first and second arms of each said "U"-shape abutting on a said knot, each said resilient tubular member having in cross-section a substantially uniform wall thickness, a said "U"-shaped bend fixing each resilient tubular member in a respective said hole, and each resilient tubular member being of substantially inextensible tubular material.

* * * * *